US005234230A

United States Patent [19]

Crane et al.

[11] Patent Number: 5,234,230

[45] Date of Patent: Aug. 10, 1993

[54] ANKLE AND FOOT PROTECTIVE DEVICE FOR ATTACHMENT TO A SKATE

[76] Inventors: Scott A. Crane, 4436 Turquoise Dr., Affton, Mo. 63123; James R. Varney, 35 Plant Ave., Webster Groves, Mo. 63119

[21] Appl. No.: 988,768

[22] Filed: Dec. 10, 1992

[51] Int. Cl.[5] ..... A63C 3/00

[52] U.S. Cl. ..... 280/811; 36/115; 36/72 R

[58] Field of Search ..... 36/115, 132, 136, 72 R; 280/11.12, 11.18, 11.3, 811

[56] References Cited

U.S. PATENT DOCUMENTS

| | | | |
|---|---|---|---|
| 1,160,159 | 11/1915 | Freeman | 280/811 |
| 1,663,381 | 3/1928 | McKinley | 36/7.2 |
| 1,714,760 | 5/1929 | Bloomberg | 280/811 |
| 1,806,975 | 5/1931 | Johnson | 280/811 |
| 1,832,866 | 11/1931 | Johnson | 280/811 |
| 2,029,787 | 2/1936 | Ohler | 280/811 |
| 2,109,566 | 3/1938 | Fischer | 280/811 |
| 2,984,917 | 5/1961 | Saunders | 280/811 |
| 3,027,660 | 4/1962 | Werner | 280/811 X |
| 3,806,145 | 4/1974 | Czeiszperger | 280/811 |
| 4,351,537 | 9/1982 | Seidel | 280/11.12 |
| 4,408,403 | 10/1983 | Martin | 36/115 |
| 4,445,287 | 5/1984 | Garcia | 36/7.2 X |
| 4,453,727 | 6/1984 | Bourque | 280/11.12 |

OTHER PUBLICATIONS

Popular Science Jan./40 p. 127.

*Primary Examiner*—Margaret A. Focarino
*Assistant Examiner*—Michael Mar
*Attorney, Agent, or Firm*—Kalish & Gilster

[57] ABSTRACT

An ankle and foot protective device is provided for attachment to a skate. The device has at least one support layer adapted for releasable attachment to the outside of a skate and at least one protective pad adapted for attachment to the at least one support layer.

14 Claims, 4 Drawing Sheets

ANKLE AND FOOT PROTECTIVE DEVICE FOR ATTACHMENT TO A SKATE

BACKGROUND OF THE INVENTION

1. Field of the Invention

The present invention relates generally to foot protective devices, and, more specifically, to a multipart device for attachment to an ice skate to protect the skater's feet and ankles from cuts and blows.

2. Description of the Prior Art

Previously, a variety of covers for ice skates have been devised which function to shield the skater's feet from cold and dampness. These covers include a buckle closing overshoe patented by Freeman (U.S. Pat. No. 1,160,159); a tie and snap-on skate jacket patented by Bloomberg (U.S. Pat. No. 1,714,760); a tie-on device patented by Ohler (U.S. Pat. No. 2,029,787); a zip-on overshoe patented by Fischer (U.S. Pat. No. 2,109,566); and an insulating cover which buckles and ties onto the skate, which was patented by Saunders (U.S. Pat. No. 2,984,917).

In each case, these covers, although providing some protection from the environmental conditions, do not serve to adequately shield the wearer's feet from cuts and bruises which often occur, particularly during hockey games, from contact with other skaters' blades, hockey pucks and sticks. Moreover, these skate covers are all constructed in such manner that applying them to and removing them from the user's skate is quite time-consuming and ordinarily requires the use of two hands.

It is well known by participants in the sport of ice hockey that broken bones and severe bruises, as well as lacerations of the feet and ankles, occur all too commonly during the course of normal play. Such injuries may be completely debilitating, and mere anticipation of such an injury may prevent the hockey player from participating to the fullest extent of his ability; in either case, with the resultant consequences of lost games, decreased gratification, and possibly even lost employment.

Various attempts by others have been made to address these concerns. For example, U.S. Pat. Nos. 1,806,975 and 1,832,866 which both issued to Johnson, disclose toe guards to crimp onto the extreme forward end of an ice skate and which were secured by the skate's laces. These devices do nothing to protect the sides and heel of the foot or the ankles, and were awkward and time consuming to attach to and remove from the user's skates.

An alternative protective device was illustrated in *Popular Science* magazine in 1940 which consisted of a chain mail jacket worn over the entire skate, except the toe region. Clearly such a jacket would be very heavy, contributing of course to player fatigue, which itself can lead to increased injuries and decreased performance.

More recently, U.S. Pat. No. 3,806,145, which issued to Czeiszperger, discloses a skate guard of hard plastic molded to conform to the shape of a skate shoe or "boot". The device includes a toe and foot side guard fitted to a particular skate and secured semi-permanently or permanently by stapling or gluing a flange to the sole of the skate shoe. No provision is made in this device for protection of the top of the foot and the ankle, and it is sized and fixed to a particular skate, not for easy attachment and selective removal or interchangeability from one pair of skates to another.

Patents for goal-tender's skates, U.S. Pat. Nos. 4,351,537 and 4,453,727, which issued to Seidel and Bourque, respectively, disclose skates which are formed of hard plastic to protect the wearer's feet from injury caused by blades and flying pucks and stick blows. In each case the protective skate shoe portion is rigid, limiting foot movement to some extent, and is a permanent part of the skate, limiting usefulness.

Nothing in the prior art suggests a multi-part, multifunction skate attachment which conveniently and comfortably protects the both the feet and ankles of the skate wearer, thus optimizing use and the intended protective function.

SUMMARY OF THE INVENTION

Accordingly, it is among the objects of the present invention to provide a device for attachment to skates for protection of the feet and ankles of the user, which may be facilely applied to any conventional ice skates, or even to roller skates, and especially hockey skates, and which may be rapidly and easily adjusted and at least partially removed, even during play, as desired.

It is further among the objects of the present invention to provide a skate attachment, having the features indicated, which may be provided in several sizes, each of which may be used with skates ranging over at least several sizes, and which is interchangeable, for use on either the left or right skates with equal success.

It is also among the objects of the present invention, having the above features, to provide a skate attachment which is light-weight, flexible and comfortable, but constructed so as not to inhibit movement, while simultaneously being strong enough to deter or completely prevent cuts, broken bones and bruises which commonly occur as a result of foot contact with hockey sticks, other skaters' blades, and flying hockey pucks.

Thus, in keeping with the above objects, the present invention is, briefly, an ankle and foot protective device for attachment to a skate. The device includes at least one support layer adapted for removable attachment to the outside of a skate and at least one protective pad adapted for attachment to the at least one support layer.

This invention is also, briefly, an ankle and foot protective device for attachment to the outer surface of a conventional skate boot. The device includes a support layer adapted to be attached to and substantially cover left and right side portions, respectively, of the skate boot, structure for removably securing the support layer to the skate boot, first and second protective pad members, and structure for removably securing the first and second pad members to the support layer along each of the left and right side portions respectively, of the skate boot, wherein each of the pad members has a substantially planar configuration which extends across a major portion of a respective one of the left and right side portions. The support layer can be a first support layer and a second support layer.

Further in keeping with the above objects, the present invention is also, briefly, an ankle and foot protective device for attachment to a skate, which device includes a first support layer and a second support layer connected to the first support layer. The first support layer and the second support layer are adapted for attachment to the outside of a skate on left and right outer surfaces thereof so as to substantially cover an entire side of the foot and the ankle on both the inside and the outside of a wearer's foot, and further are adapted for rapid selectively removable attachment of a first protective pad and a second protective pad to the first support layer and the second support layer, respectively. The device includes an adaptation for releasably connecting the second support layer and the first support layer and an adaptation for attaching the first support layer and the second support layer to the outside of a skate, as well as a first protective pad and a second protective pad adapted for rapid selectively removable attachment to the first support layer and the second support layer, respectively. There is also included an adaptation for rapid selectively removable attachment of the first protective pad to the first support layer, and for rapid selectively removable attachment of the second protective pad to the second support layer.

Other objects and advantages will be in part apparent and in part pointed out hereinbelow.

BRIEF DESCRIPTION OF THE DRAWINGS

Throughout the various figures like parts are indicated by like element numbers.

DESCRIPTION OF PRACTICAL EMBODIMENTS OF THE INVENTION

Figure 1:
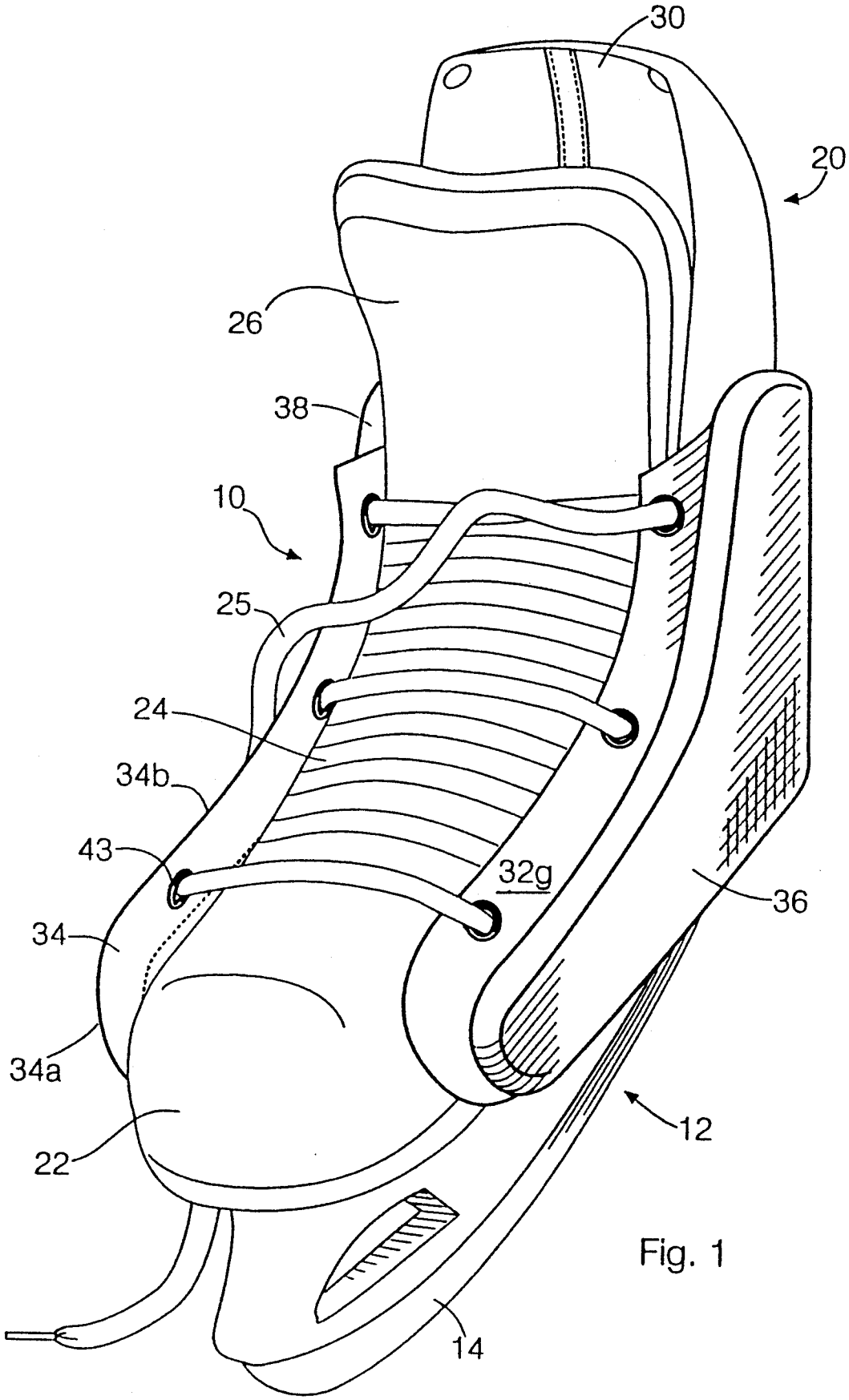
FIG. 1 is a top, front perspective view of a multipart protective device for attachment to a skate, the device being constructed in accordance with and embodying the present invention, and shown mounted as for wear on a schematically illustrated hockey skate.

With reference to the drawings, and particularly as seen in FIGS. 1–3, 10 generally designates a multi-part protective device for attachment to a skate 12, shown schematically as a conventional hockey skate. It is understood that, in keeping with the invention, device 10 may also be used, if desired, for attachment to a figure skate or roller skate (especially those having the rollers arranged in a single line and commonly used by hockey players for practice), but is considered especially useful for attachment to bladed hockey skates for protection of the player's feet and ankles from injury, as previously discussed.

Skate 12 is not specified as being either left or right because device 10 is constructed so as to be useful for either skate. Thus, each member of a pair of devices 10 is preferably identical to the other, and may be used interchangeably, for convenience of use and economy of manufacture. As is customary, skate 12 has a metal blade 14 mounted by supports, such as, for example, 16*a*, 16*b*, 16*c* to the bottom of a rigid sole 18. A leather boot 20 is mounted on the top of sole 18 and includes a toe 22 and an upper 24, which connects to and extends rearwardly from toe 22 so as to cover the arch portion of the wearer's foot, and terminates centrally in tongue 26.

The sides of boot 20 are not seen in the illustrations, being covered by device 10, but extend in the usual manner on each left and right side of boot 20 from toe 22, rearwardly to heel 28, and are connected to each other laterally across tongue 26 and arch 24 by laces 25. Heel 28 in turn extends from its attachment to sole 18 upwardly to terminate in a collar 30 which extends laterally around the back of the wearer's lower leg to protect and hold the ankle and Achilles' tendon. Whether constructed primarily of leather, or alternatively, of a somewhat pliable synthetic material, boot 20 alone does not provide sufficient protection from injuries which commonly occur during the normal course of a hockey game or practice session. However, it is not considered desirable for the majority of players to use the extremely rigid, hard-bodied boots ordinarily worn by goal tenders, as such are much too heavy and cumbersome and would impede the player's necessary speed and ability to maneuver.

Thus, to overcome these obstacles, protective device 10 is formed of left and right flexible support layers 32, 34, respectively, which connect to each other and are attached to skate 12, as described hereafter, and left and right protective pads 36, 38, respectively, which mount on corresponding support layers 32, 34 for protection of the entire left and right sides of the wearer's foot and ankles. Currently, hockey skates have hard internal shields which adequately protect the player's toes. Thus, the preferred form of device 10 does not incorporate any elements for toe protection. However, it is conceivable that such elements may be added.

Figure 2:
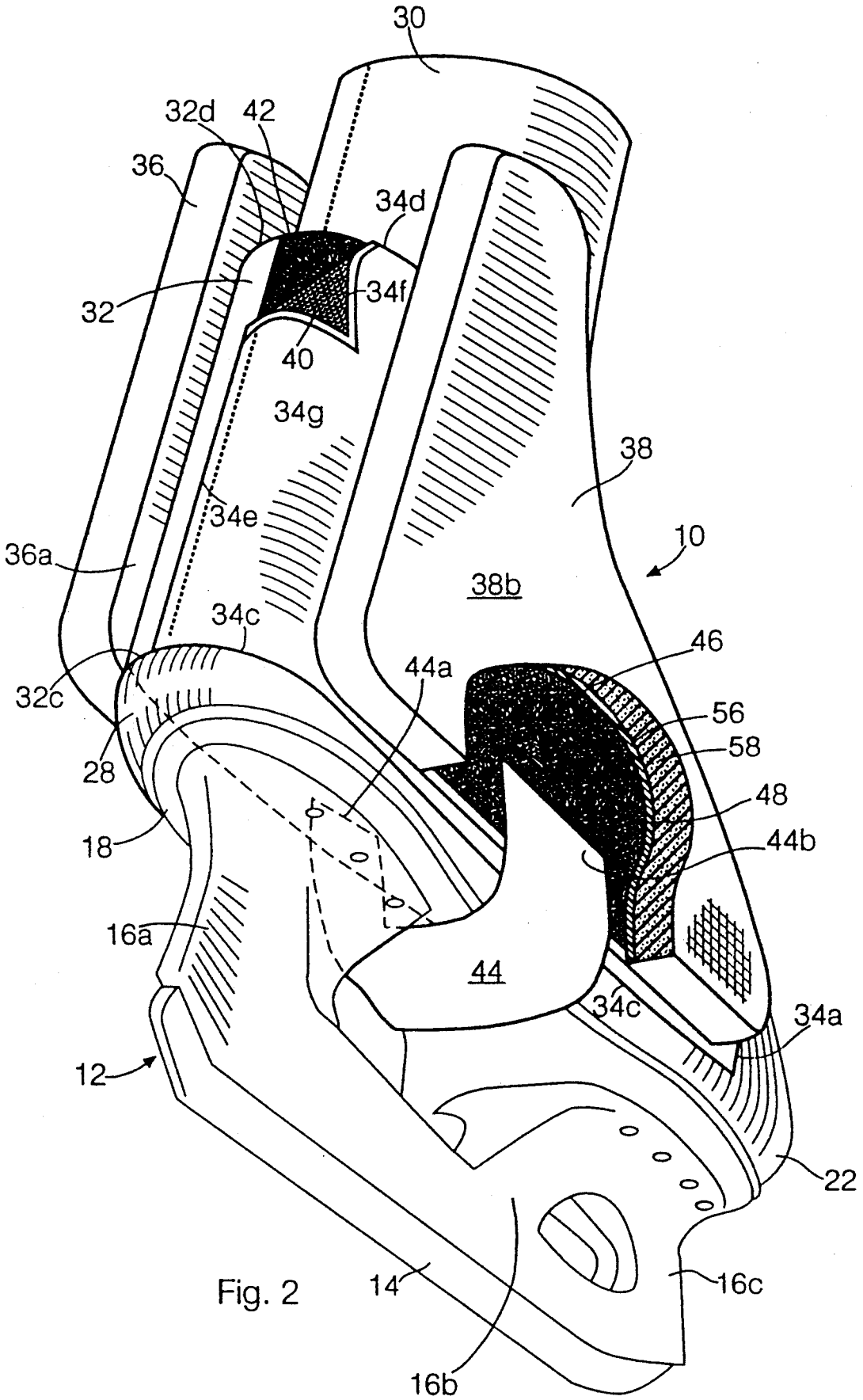
FIG. 2 is a bottom, rear perspective view of the attachment of FIG. 1, shown partially broken away, and partially opened.
Figure 3:
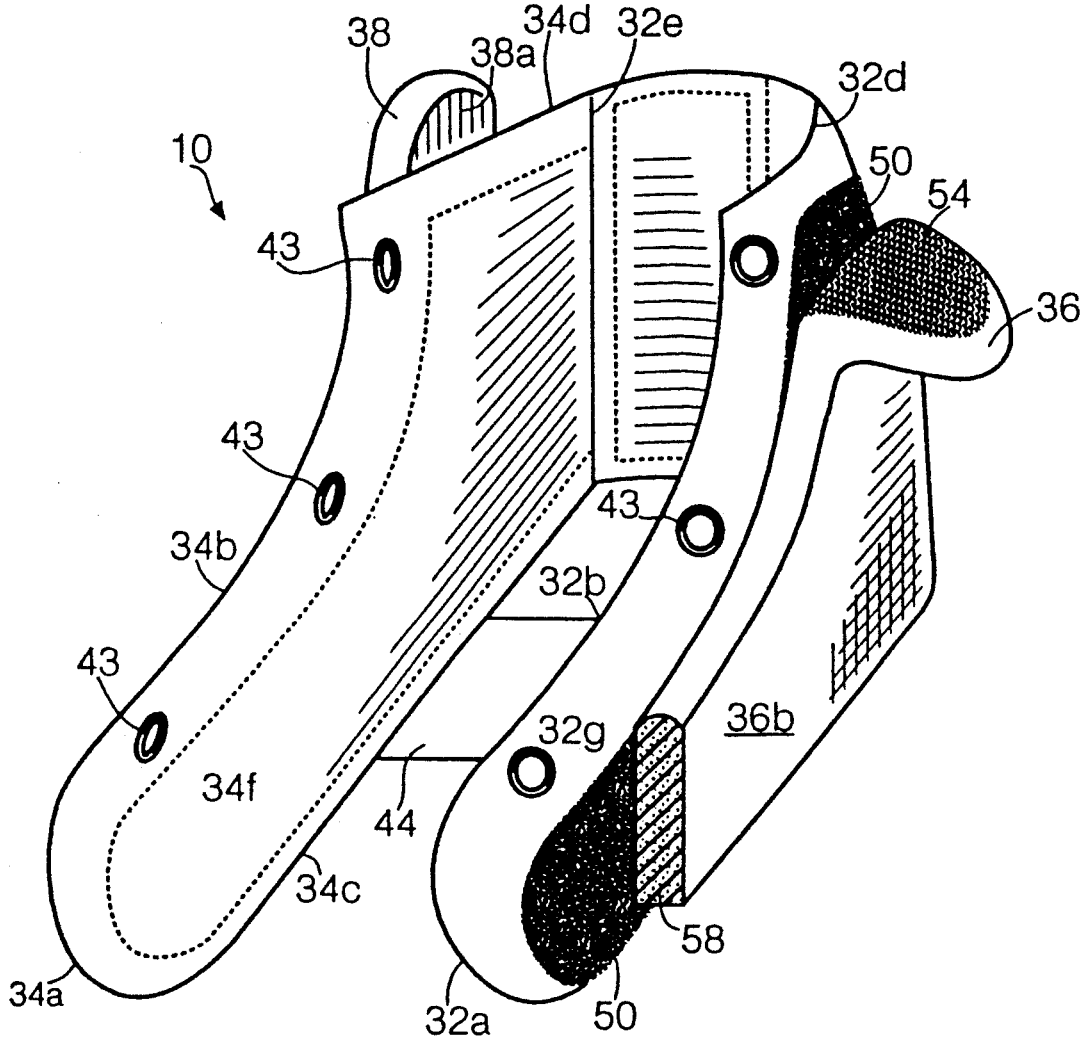
FIG. 3 is a top front perspective view of the skate attachment of FIG. 1 shown separately, without a skate, partially broken away and partially separated.

Support layers 32, 34 each have a reclined "L" configuration for following the general outline of the sides of a foot and ankle, and are positioned for use with the wide ends thereof overlapping one another behind heel 28 and collar 30, as shown in FIGS. 2 and 3. More specifically, support layers 32, 34 are made from a tough flexible fabric, preferably of the type referred to as "ballistic" nylon cloth, which is substantially waterproof and very resistant to cutting or tearing, to thereby deter blade cuts to the foot, in addition to decreasing dampness and its inherent effects.

Each support layer 32, 34 has corresponding toe ends 32*a*, 34*a*, from which there extend rearwardly, curved front edges 32*b*, 34*b*, and straight bottom edges 32*c*, 34*c*, such that front edges 32*b*, 34*b* generally follow the outline of upper 24 and tongue 26. Curved front edges 32*b*, 34*b* terminate and intersect at a sharp angle with rearwardly extending horizontal edges 32*d*, 34*d* respectively, which in turn extend to and intersect with vertical back edges 32*e*, 34*e*. Vertical back edges 32*e*, 34*e* extend downwardly and intersect with substantially horizontally positioned bottom edges 32*c*, 34*c*, completing the overall reclining L-shape.

Support layers 32, 34 each have respective inner surfaces 32*f*, 34*f* and outer surfaces 32*g*, 34*g*, the inner surfaces 32*f*, 34*f* being positioned during use so as to face and be in contact with the sides of boot 20. Outer surfaces 32*g*, 34*g* provide a site for supporting pads 36, 38 thereon.

With reference to FIG. 3, inner surfaces 32*f*, 34*f* are, for the most part, completely smooth. However, adjacent to back edge 34*e*, inner surface 34*f* preferably has a rectangular strip 40 of material attached, the material being of the type which bears small barbs or hooks, such as that known by the trademark, VELCRO. On outer surface 32*g*, adjacent to vertical back edge 32*e* there is attached a rectangular strip 42 of material bearing small loops for selectively removable engagement with the barbs on strip 40. Thus, by overlapping strip 42 with strip 40 support layers 32, 34 can be quickly and releasably connected behind heel 28 and collar 30 of boot 20.

Strips 40, 42 are preferably permanently fixed to support layers 32, 34 by stitching thereto. However, other methods of attaching the strips, such as by gluing, will suffice; and other mechanisms, such as snaps can be used to connect support layers 32, 34 near back edges 32*c*, 34*c* instead of strips 40, 42.

As shown in FIG. 1, adjacent to front edges 32*c*, 34*c*, support layers 32, 34 each have preferably three eyelets 43 spaced therealong for attaching support layers 32, 34 by laces 25 to boot 20. A greater or lesser number of eyelets 43 may be used, but three along each edge provides sufficient connection to skate 12 without requiring a great deal of time for attachment.

FIGS. 2 and 3 show that bottom edges 32*c*, 34*c* are releasably secured in position on skate 12 by strap 44, which is preferably formed of elastic and attached by stitching at one end 44*a*, as shown in phantom in FIG. 2, substantially centrally along the length of bottom edge 32*b* of support layer 32. When in position on skate 12, strap 44 extends from end 44*a* beneath sole 18, between blade supports 16*a*, 16*b*, for example, and terminates in end 44*b*. End 44*b* has fabric strips 46, 48 connected on the inner and outer surfaces thereof for attachment to support layer 34 and protective pad 38, in the preferred manner, as described hereafter. As seen in FIG. 2, fabric strip 46 is coated with VELCRO hooks, for selectively releasable interlocking attachment to corresponding loop-laden fabric patch 48 on support layer 34. Likewise, fabric strip 48 is coated with VELCRO loops, for selectively releasable interlocking attachment to the corresponding hook-bearing fabric inner surface 38*a* of protective pad 38.

It is to be understood that ends 44*a*, 44*b* of strap 44 can be reversed with equal success, but are described and shown only in one position, for clarity of the drawings and simplicity of discussion. Of course, other methods of attaching strap 44 are conceivable which will function adequately.

The areas of outer surfaces 32*g*, 34*g* which pass parallel to the wearer's foot are almost completely covered with patches 50, 52 of a material, such as VELCRO, coated with small closed loops, to provide a mounting site for protective pads 36, 38, respectively. Preferably, for ease of handling, a narrow, smooth, loop-free border of material remains just within the perimeter of each outer surface 32*g*, 34*g* and provides an area for convenient gripping of support layers 32, 34, as well as a place for attachment of eyelets 43.

Protective pads 36, 38 are desirably flat, being formed from flexible sheets of high impact-resistant foam, also preferably covered on the corresponding inner surfaces 36*a*, 38*a* and outer surfaces 36*b*, 38*b* with ballistic nylon cloth, for the same reasons as cite above. Pads 36, 38 may vary in thickness as desired, but most commonly will be within the range of ¼ to ¾ inch thick. If preferred, a player may have a pad on the inside of skate 12 which is thinner than that on the outside, so as to provide the greatest protection where needed, but also so as to avoid having the inner pads on the right and left skates catch or otherwise interfere with each other during skating, as may happen if the pads are too thick. Similarly, it is important that the pads on the outside of the foot not be too thick, to ensure that no contact of the pad can be made with the ice during sharp turns, when the skate is angled toward the ice, which contact can result in a fall.

Although the flexible pads described are preferred for comfort, in certain situations, for example, where there has been a pre-existing injury, a more rigid protective shield for the foot may be desired. In that case, an optional shield 56 formed as a thin sheet of "unbreakable" hard plastic may be added to pads 36, 38, for example, as illustrated in FIG. 2. Although shield 56 must be formed of a material which is tough enough to resist breaking upon impact with a puck moving at very high speeds, it may be made of a material which has a certain amount of "give", for improved comfort, or, alternatively, from a lightweight metal. Shield 56 may be incorporated into the pad by permanently enclosing it within the ballistic nylon cloth cover either to the inside or outside of the foam core portion 58.

Alternatively, other methods of connecting the shield may be used. For example, the cloth cover of the pad may be constructed with a pocket (not shown) for slidable temporary receipt and removal of the hard plastic shield, as desired. Shield 56 may be shaped as desired, for example as an elongated strip positioned to shield only the side of the foot, or with the same shape as the associated pad, to cover the user's ankle region as well.

Of course, either or both pads 36, 38 may be removed from one or both skates, as a particular player may wish, depending upon the circumstances. For example, a player's assigned position during the game or certain habits and ways of moving may create an increased tendency toward injuries at one particular point on his foot, but not elsewhere. Such a player may choose to wear only the pad which would protect that area, and take the risk of injury to other areas. Other players may prefer to always wear a pad on each side of each foot.

Figure 4:
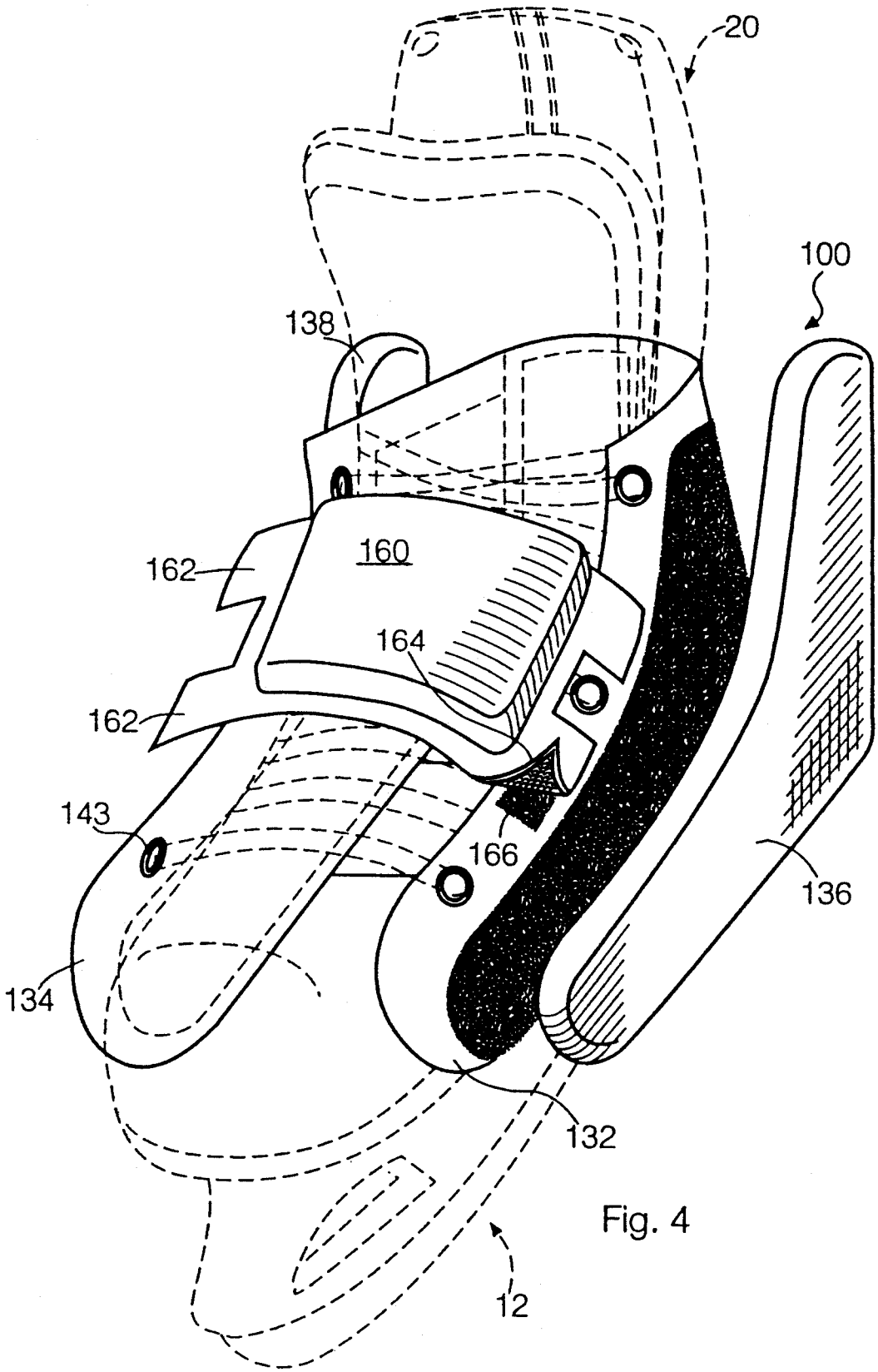
FIG. 4 is a top, front perspective view of another embodiment of the skate attachment of FIG. 1, partially separated, the associated skate shown in phantom.

FIG. 4 illustrates an alternative embodiment of the new protective device, generally designated 100 and shown mounted as for use on a skate 112, shown in phantom. Device 100 is in most respects identical to device 10, with one exception. Thus, for simplicity, all identical parts bear the same reference number as used in the previous embodiment, but preceded by the numeral 1.

Protective device 100 includes left and right support layers 132, 134 connected to each other and attached to skate 112 as described in regard to the previous embodiment and having protective pads 136, 138 for removably mounting thereon in accordance with the embodiment just described. Device 100 has the added feature of an instep protection pad 160 most conveniently formed from a rectangle of high impact-resistant foam enclosed in ballistic nylon cloth and sized appropriately for covering the upper arched portion of a skater's foot. Pad 160 is provided with flexible extensions 162 of cloth at each corner thereof. Extensions 162 provide a site for mounting hook bearing material patches 164. Similarly sized loop-bearing patches 166 are positioned between adjacent eyelets 143 to provide an attachment site for patches 164.

Clearly patches 166 may be placed between all adjacent eyelets 142, or only between certain select pairs thereof, depending upon the number and placement of eyelets 143 and the size of instep pad 160. Pad 160 may formed as one large pad, or as several narrow pads which may be applied transversely over only certain select parts of the arch of the foot, or even over the top of the player's toes or the front of the lower leg, as desired.

It is apparent that the above-described construction of the new ankle and foot protective device for attachment to a skate will do a great deal to reduce the incidence of serious and sometimes permanent injury occurring to hockey players. Also, there are several secondary advantages created, including comfort and cosmetics. Although not having warmth as its primary purpose, it is expected that a side effect of partially covering a skate with layers of material and foam will result in some warming of the user's foot, and the preferred material is inherently water-proof, decreasing uncomfortable dampness reaching the user's foot, and may be washed or wiped off when soiled. Certainly it is conceived, however, that other materials and means of attaching the pads to the support layers may be contrived.

Also, and perhaps of greater interest to professional hockey players than to children or other casual players, is the appearance of the new device, which while performing a very important protective function, is effectively invisible to the ordinary observer when provided in the color black and worn on a black skate. However, if it is desired to advertise a particular team's logo, for example, smooth outer pad surfaces 36*b*, 38*b* provide an optimal site for affixing an emblem, insignia, etc. Optionally, further VELCRO attachments can be added to the outer surfaces of each pad so that such insignia can be easily interchanged at will, but are secure during play.

A further advantage of the described protective device is that because of the inherent adjustability offered by the VELCRO and skate lace connections it is only necessary to manufacture the device in a few sizes, which will each fit skates over a wide range of skate sizes. For example, only one or two children's sizes, and men's and women's sizes small, medium and large may be sufficient to fit skates of virtually all sizes. Regardless of the size selected, all the protective devices fold up compactly for storage or carrying to a size roughly equivalent to a standard paper back book.

It is also clearly seen that the described protective device can be very quickly and easily mounted on a particular pair of skates, or changed to a new pair. Because it is not connected as a permanent part of the skate there is very little expense involved in having a safer skate available for regular use. If desired the new protective device may be used only during practice and not during actual games, without requiring two pairs of skates. Nevertheless, it may also be worn at all times the skates are used because there is no discomfort and no noticeable weight added by the device. p Also, because skate laces are frequently cut during games, and commonly break from normal wear, it will be appreciated that the associated laces can be changed without entailing any additional effort when the device is in place. The pads may be left in the preselected positions on the support layers which in turn remain connected between the sole and the blade during lace replacement. This time saving measure is of course of particular importance during the course of a game, when even fractions of a second are critical. Likewise it is especially significant that the various pads of the new device can be instantly ripped from the support layers and tossed aside, or repositioned as necessary, even during play, while securely maintaining their preselected locations without shifting until intentionally removed.

Lastly, and perhaps secondary in importance only to the actual physical benefits offered by the new protective device, is the added advantage that when wearing it a player necessarily feels more secure, not fearing the previously risked serious injuries, and thus is able to play "harder", more surely, focusing entirely on the task at hand, rather than on the risk to foot.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. An ankle and foot protective device for attachment to the outer surface of a conventional skate boot, the device comprising:

support layer means adapted to be attached to and substantially cover left and right side portions, respectively, of the skate boot, means for removably securing the support layer means to the skate boot, first and second protective pad members, and means for removably securing the first and second pad members to the support layer means along each of said left and right side portions respectively, of the skate boot, wherein each of said pad members has a substantially planar configuration which extends across a major portion of a respective one of said left and right side portions.

2. The device of claim 1, wherein said support layer means comprises a first support layer and a second support layer.

3. The device of claim 1, wherein said support layer means is formed of a flexible fabric material.

4. The device of claim 3, wherein the flexible fabric material is ballistic nylon fabric.

5. The device of claim 3, wherein the flexible fabric material is substantially waterproof:

6. The device of claim 1, wherein said at protective pad members are formed of high impact-resistant foam.

7. The device of claim 1, wherein said at protective pad members are covered with ballistic nylon cloth.

8. The device of claim 2, further including means for connecting said second support layer to said first support layer comprising corresponding interlocking strips of hook and loop bearing fabric fixed to overlapping ends of said first support layer and said second support layer to thereby cause said first support layer and said second support layer to be selectively releasably connected.

9. The device of claim 2, further including means for attaching said first support layer and said second support layer to the outer surface of a skate comprising a plurality of eyelets formed in said first support layer and said second support layer for penetration by laces of the skate.

10. The device of claim 2, further including means for attaching said first support layer and said second support layer to the outer surface of a skate comprising a strap having first and second opposed ends and extending beneath the skate, between a sole and a blade thereof, the first end of said strap being fixed to one of said first support layer and said second support layer and the second end of said strap being adapted for selectively releasable connection to the other of said first support layer and said second support layer.

11. The device of claim 2, further including means for attachment of said first protective pad member to said first support layer is comprising patches of corresponding selectively releasable interlocking hook and loop bearing fabric fixed to facing surfaces of said first support layer and said first protective pad member, and means for attachment of said second protective pad member to said second support layer comprising patches of corresponding selectively releasable interlocking hook and loop bearing fabric fixed to facing surfaces of said second support layer and said second protective pad member to thereby cause said first protective pad and said second protective pad member to be selectively and rapidly removable from said first support layer and said second support layer, respectively.

12. The device of claim 1, further comprising a plastic shield for increased protection of the wearer's foot.

13. The device of claim 2, and further comprising a third protective pad member adapted for selectively releasable connection to said first support layer and said second support layer so as to be positioned across a portion of a tongue and laces of the skate to thereby provide protection of an instep of a wearer's foot.

14. The device of claim 13, wherein said third protective pad member is formed of high impact-resistant foam and fabric surrounding the foam, the fabric extending laterally beyond the foam, and means attached to the fabric where the fabric extends beyond the foam for selectively releasable connection of said third protective pad to said first support layer and said second support layer.

* * * * *